US005799370A

United States Patent [19]

Davidian et al.

[11] Patent Number: 5,799,370

[45] Date of Patent: Sep. 1, 1998

[54] ADJUSTABLE HINGE

[75] Inventors: Richard M. Davidian, Avon; Kevin C. Brielmann, Cheshire, both of Conn.

[73] Assignee: The Stanley Works, New Britain, Conn.

[21] Appl. No.: 662,036

[22] Filed: Jun. 12, 1996

[51] Int. Cl.[6] ..... E05D 7/04

[52] U.S. Cl. ..... 16/236; 16/241; 16/242; 16/243; 16/246; 16/248

[58] Field of Search ..... 16/235, 236, 237, 16/239, 240, 241, 242, 245, 246, 247

[56] References Cited

U.S. PATENT DOCUMENTS

| | | | |
|---|---|---|---|
| 880,317 | 2/1908 | Von De Marwitz | 16/246 |
| 928,760 | 7/1909 | Hunter . | |
| 1,288,907 | 12/1918 | Johnson | 16/246 |
| 1,314,732 | 9/1919 | Cochran et al. . | |
| 2,373,955 | 4/1945 | Fuller . | |
| 2,641,794 | 6/1953 | Raskin . | |
| 2,725,589 | 12/1955 | Papesh . | |
| 2,779,966 | 2/1957 | Torchia . | |
| 3,007,193 | 11/1961 | Hughes et al. . | |
| 3,596,307 | 8/1971 | Kolmetsky | 16/237 |
| 4,159,557 | 7/1979 | Pittasch et al. | 16/237 |
| 4,825,507 | 5/1989 | Killingstad | 16/241 |
| 4,837,893 | 6/1989 | Wilson | 16/240 |
| 5,058,236 | 10/1991 | Henson | 16/238 |
| 5,144,721 | 9/1992 | Schade | 16/237 |
| 5,339,493 | 8/1994 | MacIntyre | 16/238 |
| 5,375,296 | 12/1994 | Zaleskie | 16/237 |

FOREIGN PATENT DOCUMENTS

| | | | |
|---|---|---|---|
| 2686931 | 8/1993 | France | 16/245 |
| 937993 | 1/1950 | Germany | 16/239 |
| 836151 | 4/1952 | Germany | 16/239 |
| 3-39581 | 2/1991 | Japan | 16/243 |
| 3-187486 | 8/1991 | Japan | 16/237 |

*Primary Examiner*—Chuck Mah
*Assistant Examiner*—Donald M. Gurley
*Attorney, Agent, or Firm*—Pepe & Hazard LLP

[57] ABSTRACT

An adjustable hinge has a first leaf and an adjustable leaf mounting assembly which includes a second leaf, a bracket, a cam and an adjusting screw. The second leaf is mounted on the bracket and has one end extending beyond the bracket and pivotally engaged with the first leaf. The cam is rotatably mounted on the bracket and cooperates with a cam follower surface on the second leaf. The adjusting screw has a shank threadably engaged in the second leaf intermediate its ends and has its free end abutting the bracket. In operation, the rotation of the adjusting screw pivots the one end of the second leaf relative to the bracket and the rotation of the cam moves the second leaf vertically relative to the bracket.

19 Claims, 6 Drawing Sheets

ADJUSTABLE HINGE

BACKGROUND OF THE INVENTION

The present invention relates to adjustable hinges for mounting a door on a frame, and, more particularly, to an adjustable hinge which enables the position of the door to be adjusted relative to the frame in both vertical and horizontal directions.

Adjustable hinges are widely employed to adjust doors relative to frames so that the doors will be level and fit well within the frame. The adjustable hinges which are presently available are more complex, expensive and generally more difficult to install than conventional non-adjustable hinges. Moreover, adjustable hinges are often time-consuming and sometimes difficult to adjust because of the difficulty in manipulation of the adjustment mechanisms and the requirement for additional support for the door during adjustment.

It is an object of the present invention to provide a novel adjustable hinge for mounting a door on a frame which enables facile vertical and horizontal adjustment of the door relative to the frame.

It is also an object to provide such an adjustable hinge which is readily installed on the door and its frame.

Another object is to provide such an adjustable hinge which enables adjustment without requiring additional support for the door.

A further object is to provide such an adjustable hinge which is rugged and long-lived, and which may be fabricated relatively easily and economically.

SUMMARY OF THE INVENTION

It has now been found that the foregoing and related objects may be readily attained in an adjustable hinge for pivotally mounting a door to a frame, comprising a first leaf mounted on one of a frame and a door and an adjustable leaf mounting assembly mounted on the other of the frame and door. The mounting assembly includes a bracket, a second leaf, a cam and an adjusting screw. The second leaf is mounted on the bracket and has one end extending beyond the bracket and pivotally engaged with the first leaf. The cam is rotatably mounted on the bracket and cooperates with a cam follower surface on the second leaf. The adjusting screw has a shank threadably engaged in the second leaf intermediate its ends and has its free end abutting the bracket, whereby the rotation of the adjusting screw pivots the one end of the second leaf relative to the bracket and the rotation of the cam moves the second leaf vertically relative to the bracket.

Generally, the cam includes means for rotating the cam, and the cam follower surface bears upon the cam and is provided by a recess in the second leaf in which the cam is rotatably seated.

Preferably, the cam is of generally cylindrical configuration and mounted for rotation about an eccentric axis, and the recess in the second leaf is a horizontally extending slot.

Conveniently, the bracket includes a locking portion, and the locking portion and the cam having interengaging means for controlling rotation of the cam relative to the bracket. The interengaging means on the locking portion and the cam include tooth surfaces on the cam and cooperating tooth surfaces on the locking portion whereby the teeth abut and prevent inadvertent rotation of the cam relative to the locking portion.

Desirably, the cam has a cylindrical shaft extending eccentrically from the one end thereof and the locking portion has a circular aperture in which the cam shaft is disposed. The teeth of the cam are disposed about the cam shaft and the teeth of the locking portion are disposed concentrically of the circular aperture.

Generally, the angular spacing of the teeth of the cam and the locking member is unequal whereby only a portion of the number of the teeth abut and control rotation of the cam relative to the locking member. In addition, the teeth of the cam and the locking member are cooperatively configured to allow rotation in one direction.

Preferably, the bracket includes means pivotally engaging the other end of the second leaf on the bracket, and the means pivotally engaging the second leaf includes a recess in the bracket in which the other end of the second leaf is pivotally seated. The means pivotally engaging the bracket includes a cover portion and a base portion, the second leaf being disposed between the cover portion and the base portion.

Alternatively, the means pivotally mounting the second leaf includes a vertically extending shaft fixed on the bracket, and the other end of the second leaf having a vertically extending barrel, which is pivotable about and axially movable upon the shaft. The barrel of the second leaf is provided by a pair of knuckles, and the cam follower surface bears upon the cam and is provided by a recess in the second leaf between the knuckles in which the cam is rotatably seated.

DETAILED DESCRIPTION OF THE ILLUSTRATED EMBODIMENT

Figure 1:
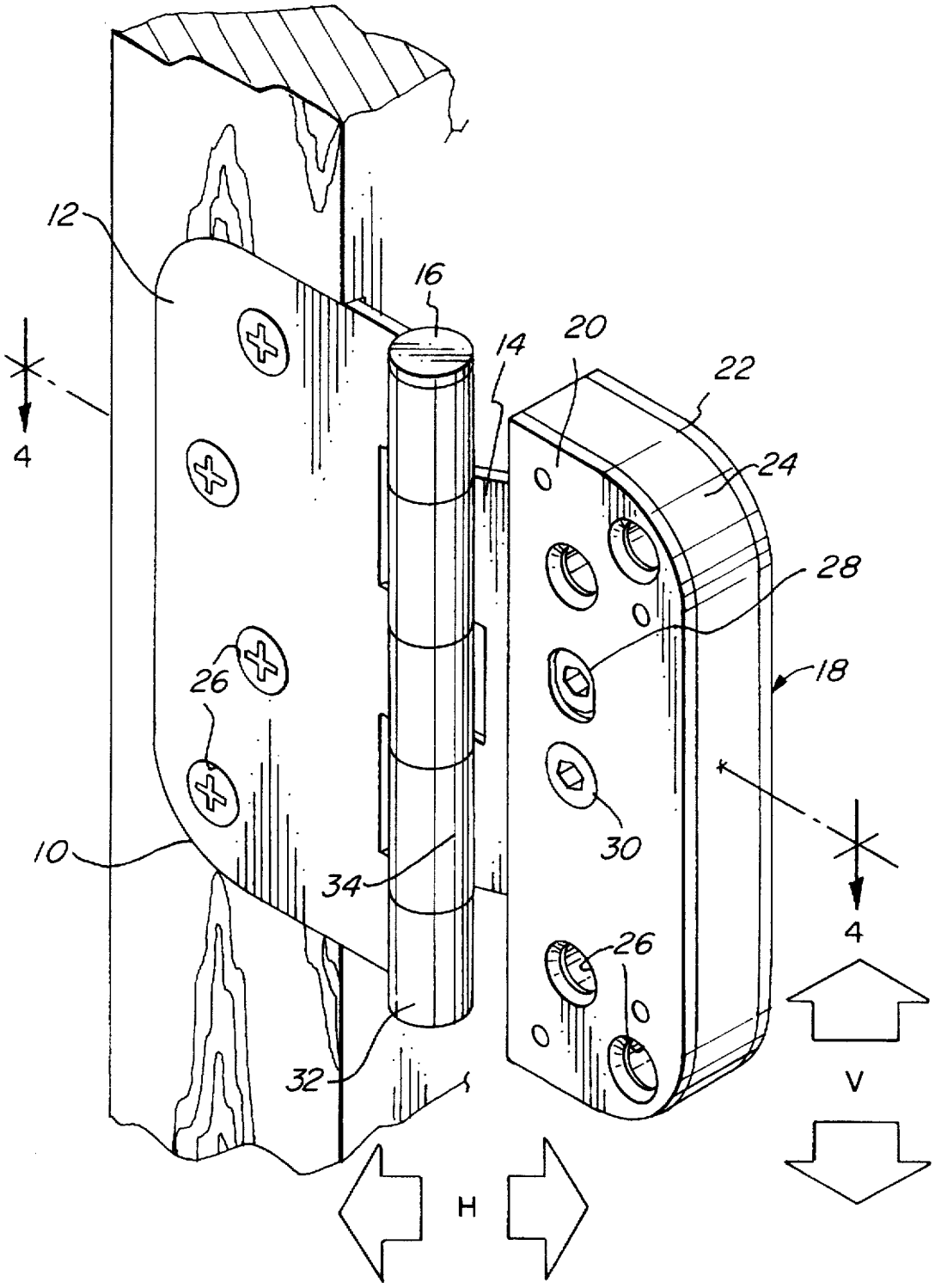
FIG. 1 is a perspective view of a door and a frame incorporating an adjustable hinge embodying the present invention.

Turning first to FIG. 1, therein illustrated is an adjustable hinge having a frame leaf 12 mounted upon a door frame 10 and a door leaf 14. The door leaf 14 is pivotably mounted within a mounting assembly generally designated by the numeral 18 which is in turn mounted upon the door (not shown). Both the door leaf 12 and the mounting assembly 18 are secured to the frame 10 and door respectively by mounting screws (not shown) seated in apertures 26.

The frame leaf 12 includes a barrel provided by the spaced knuckles 32 which mate with knuckles 34 on the door leaf 14 and a pivot pin 16 seated therein enables the leaf 14 to pivot with respect to the leaf 12. The mounting assembly 18 includes a horizontally adjusting screw 28 and a vertically adjusting cam 30 to enable the door to be adjusted with respect to the frame 10 either vertically in the directions indicated by the arrows V or horizontally in the directions indicated by the arrows H in FIG. 1. The heads of both the screw 28 and the cam 30 are accessible through apertures in the face plate 20 of the mounting assembly 18 to enable the facile adjustment of the hinge even after it is assembled on the frame 10 and door.

Figure 2:
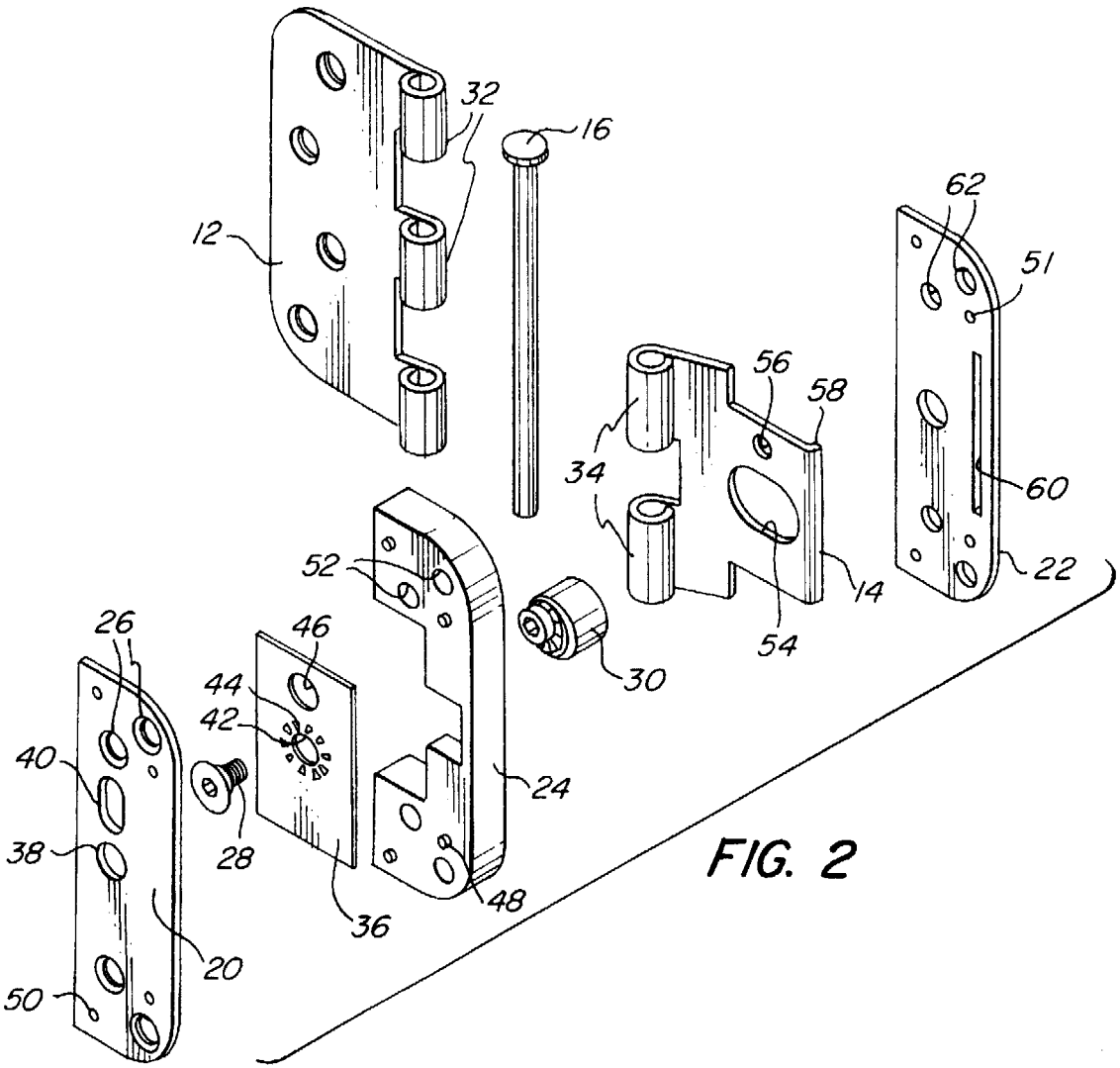
FIG. 2 is an exploded view of the adjustable hinge shown in FIG. 1.

As illustrated in FIG. 2, the mounting assembly 18 includes a bracket 22 upon which are supported a spacer member 24, locking plate 36, and face plate 20. These components are secured together and to the door by mounting screws (not shown) seated in aligned apertures 26, 52 and 62 in the face plate 20, spacer 24, and bracket 22, respectively. In addition, the components themselves are assembled together with dowels 48 which project outwardly from the upper and lower (not shown) surfaces of the spacer 24 and which fictionally seat in aligned apertures 50, 51 in the face plate 20 and bracket 22 respectively.

Figure 3:
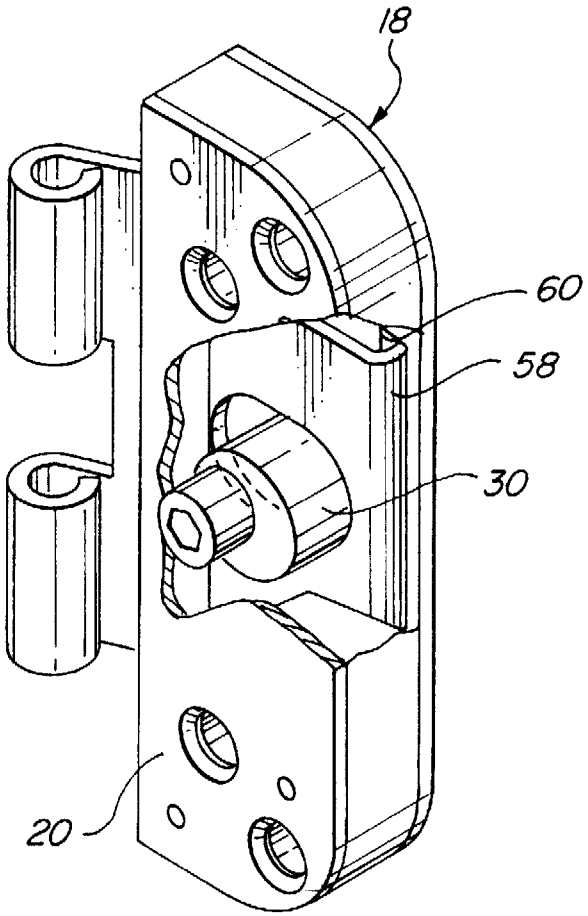
FIG. 3 is a perspective view of the door mounting assembly of the hinge with a portion cut away to show the door leaf and cam.

As seen in FIG. 3, the door leaf 14 extends between the bracket 22 and the face plate 20. On the end of the door leaf 14 opposite from the knuckles 14, is a tongue 58 which extends at an angle to the plane of the body thereof. The tongue 58 pivotably seats in a vertically extending slot 60 in the bracket 22.

Figure 5:
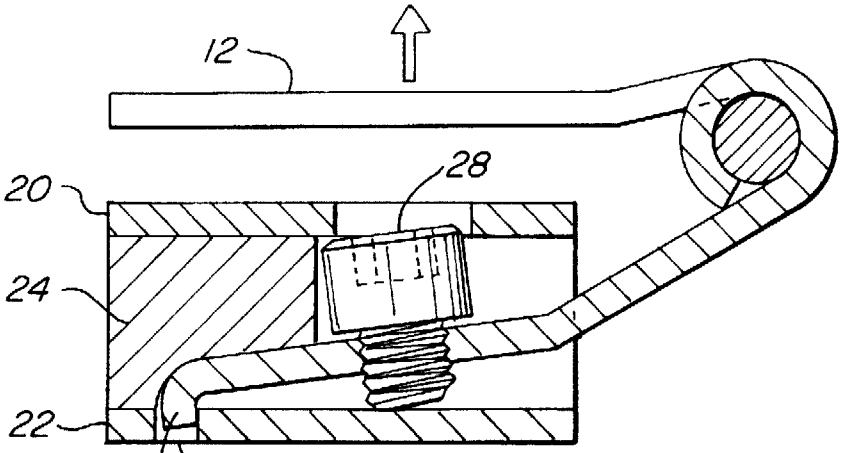
FIG. 5 is a sectional view similar to FIG. 4 with the door leaf pivoted and arrows showing the movement of both leaves.
Figure 4:
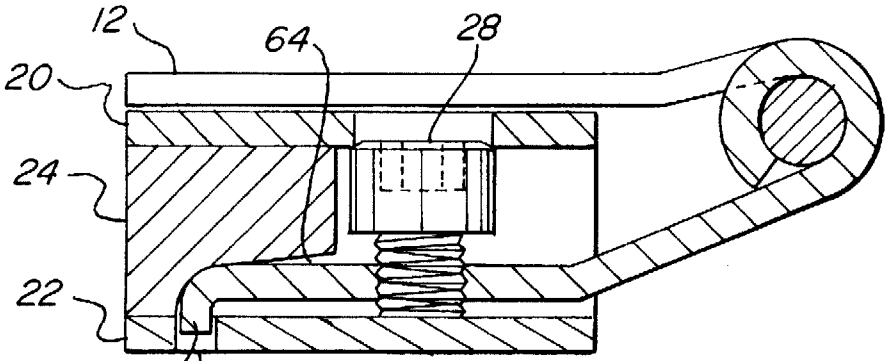
FIG. 4 is a top sectional view of the hinge along the line 4—4 of FIG. 1 and drawn to an enlarged scale.

The shank of the horizontally adjusting screw 28 is threadably engaged within a threaded aperture 56 intermediate the ends of the door leaf 14 so that the end of the shank abuts the body of the bracket 22, as shown in FIGS. 4 and 5. Although the head of the horizontally adjusting screw 28 is mounted behind the face plate 20, it is accessible through the vertically extending slot 40 in the face plate 20, and a similar slot 46 in the locking plate 36.

Figure 6:
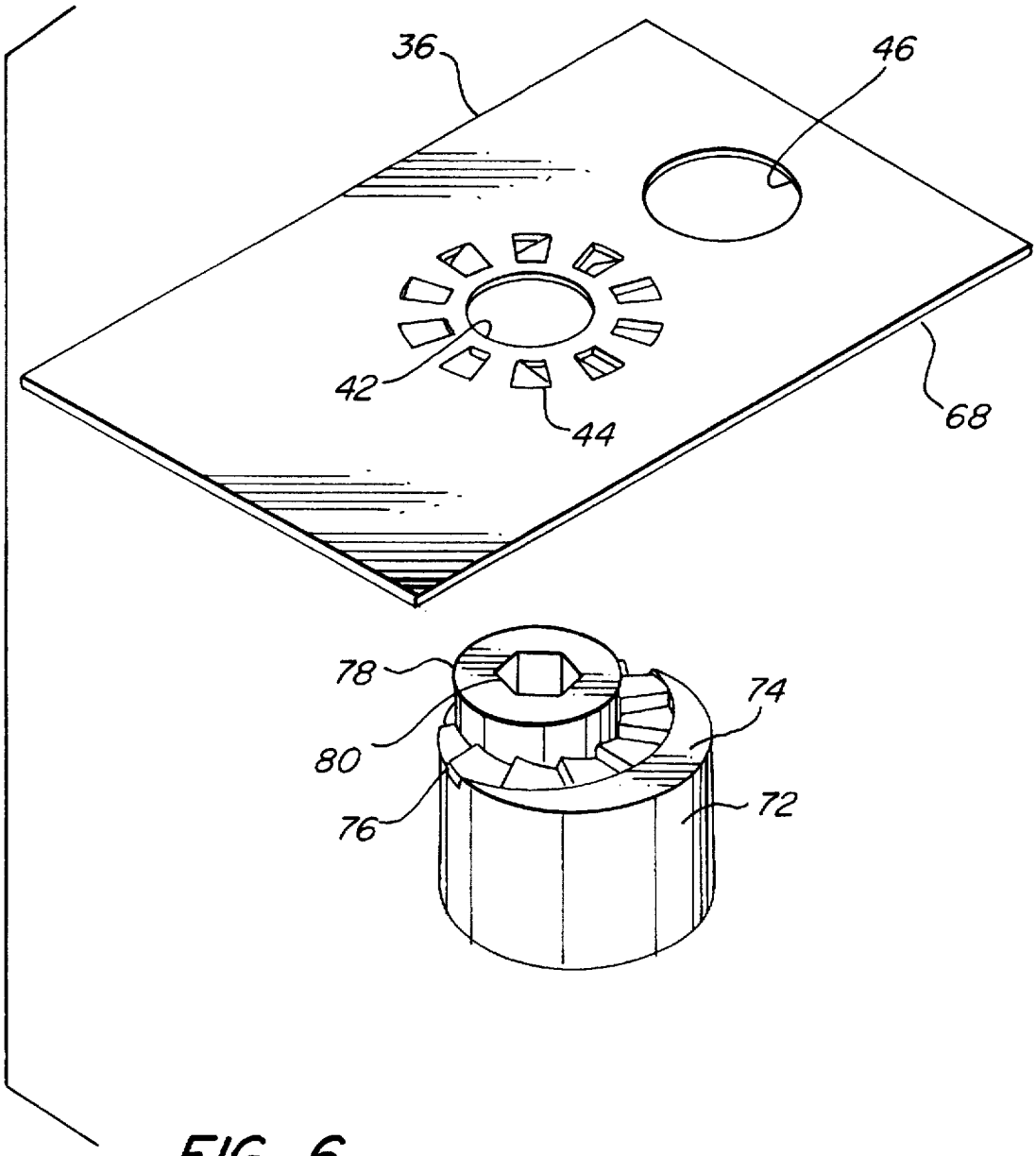
FIG. 6 is an exploded view of the cam and the locking member drawn to an enlarged scale.

As shown in FIG. 3, the vertically adjusting cam 30 is generally cylindrical and is rotatably seated within a horizontally extending slot 54 in the door leaf 14 below the aperture 56. As best illustrated in FIG. 6, the cam 30 includes a cylindrical cam shaft 78 which is offset from the axis of the body of the cam 30 to provide an eccentric cam. The cam shaft 78 is rotatably seated in a circular aperture 38 in the face plate 20, and in a circular aperture 42 in the center of the locking plate 36.

The cam 30 has ratchet teeth 76 which are cut in the crescent shaped upper surface 74 of the body of the cam 30 and about the shaft 78. The teeth 76 have faces which extend outwardly of the periphery of the cam shaft 78. The cam teeth 76 cooperate with teeth 44 which depend from the lower surface 68 of the locking plate 36 and are concentric with the circular aperture 42 in the locking plate 36. The teeth 44, 76 abut and prevent rotation of the cam 30 relative to the locking member 36 and the mounting assembly 18, but rotation can be effected by sufficient torque applied to the cam shaft 78.

The angular spacing of teeth 44, 76 is unequal so that not all the teeth 44, 76 are engaged simultaneously. This unequal spacing reduces the incremental distance between subsequent positions rotational of engagement between the teeth 44, 76.

The ramp portions of the teeth 44, 76 are oriented relative to each other in order to operate as a ratchet and permit the cam 30 to be rotated in only the counter-clockwise direction. The locking plate 36 is made of a resilient material such as spring steel so that the teeth 44 flex as the teeth 76 of the cam 30 are rotated past them from one position of engagement the next.

The horizontal adjustment operation of a hinge is illustrated in FIGS. 4 and 5. In FIG. 4, the hinge is shown in a position intermediate its range of horizontal adjustability. The horizontally adjusting screw 28 extends perpendicularly to the plane of the body of the bracket 22, and the door leaf 14 is intermediate the wedge shaped cavity 64 created adjacent the leaf tongue 58 between the spacer 24 and the bracket 22. The hinge is adjusted horizontally by rotating the horizontally adjusting screw 28 to cause the door leaf 14 to pivot either inwardly or outwardly relative to the bracket 22.

As shown in FIG. 5, the shank of the screw 28 may be rotated through the door leaf 14 to increase the spacing between the door leaf 14 and the bracket 22, thereby pivoting the door leaf 14 outwardly with respect to the bracket 22 as indicated by the curved arrow in FIG. 5. This in turn increases the spacing between the hinge leaf 12 and the face plate 20 of the mounting assembly 18.

Figure 7:
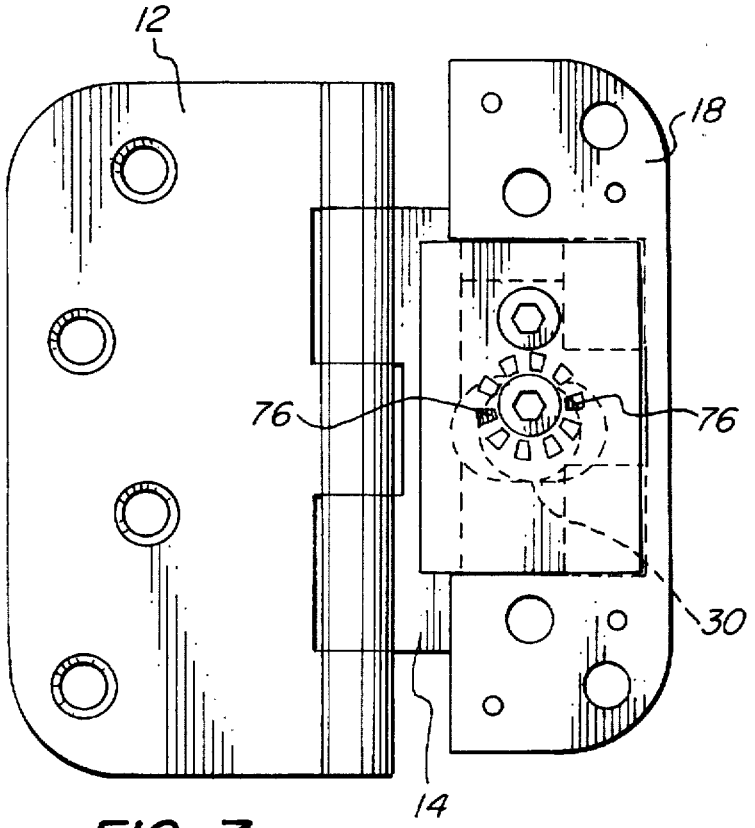
FIG. 7 is an elevational view of the adjustable hinge of FIG. 1 with the face plate removed.
Figure 8:
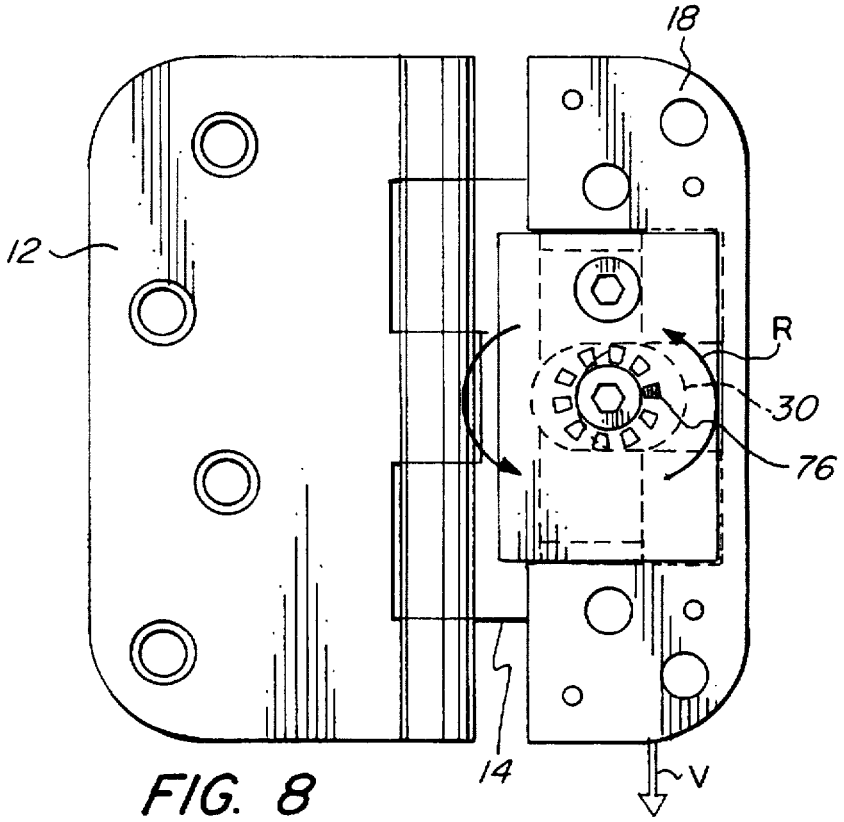
FIG. 8 is a view similar to FIG. 7 with the cam rotated and an arrow showing the movement of the mounting assembly relative to the frame leaf.

The vertical adjustment of the hinge is illustrated in FIGS. 7 and 8. In FIG. 7, the hinge is shown at its highest point in its range of vertical adjustability. The center of the cam 30 lies in the center of the slot 54, and the door leaf 14 lies below the mounting assembly 18. The outer cylindrical surface 72 of the cam 30 abuts the surface of the door leaf 14 bounding the upper portion of the slot 54 so as to bear upon it and lift or lower it. Only two teeth 76 from the cam 30 are engaged with the teeth 44 on the locking plate 36 as indicated by the shaded segments in FIG. 7 to prevent rotation of the cam 30.

The hinge is adjusted vertically by rotating the vertical adjustment cam shaft 78 with an Allen wrench (not shown) engaged in the socket 80. This rotates the cam 30 to cause the door leaf 14 to move either upwardly or downwardly relative to the bracket 22 and the mounting assembly 18. Rotating the cam 30 counter-clockwise from the position in FIG. 7 to the position shown in FIG. 8 in turn lowers the bracket 22 and the door downwardly with respect to the door leaf 14 and the frame leaf 12 as indicated by the arrow in FIG. 8.

In FIG. 8, the hinge is shown in a position intermediate its range of vertical adjustability. The center of the cam shaft 78 is intermediate the height of the slot 54, and the door leaf 14 is intermediate the mounting assembly 18. In this position, only one tooth 76 from the cam 30 is engaged with the teeth 44 on the locking plate 36 as indicated by the shaded segments in FIG. 8 to prevent rotation of the cam 30. However, the ratchet mechanism created by the unequal spacing of the teeth 44, 76 allows many more intermediate positions of tooth 44, 76 engagement than if the spacing of the teeth 44, 76 where of equal.

As the door leaf 14 moves vertically with respect to the mounting assembly 18, the screw 28 moves with it but remains accessible through the face plate 20 along the range of the vertical slot 40.

Figure 9:
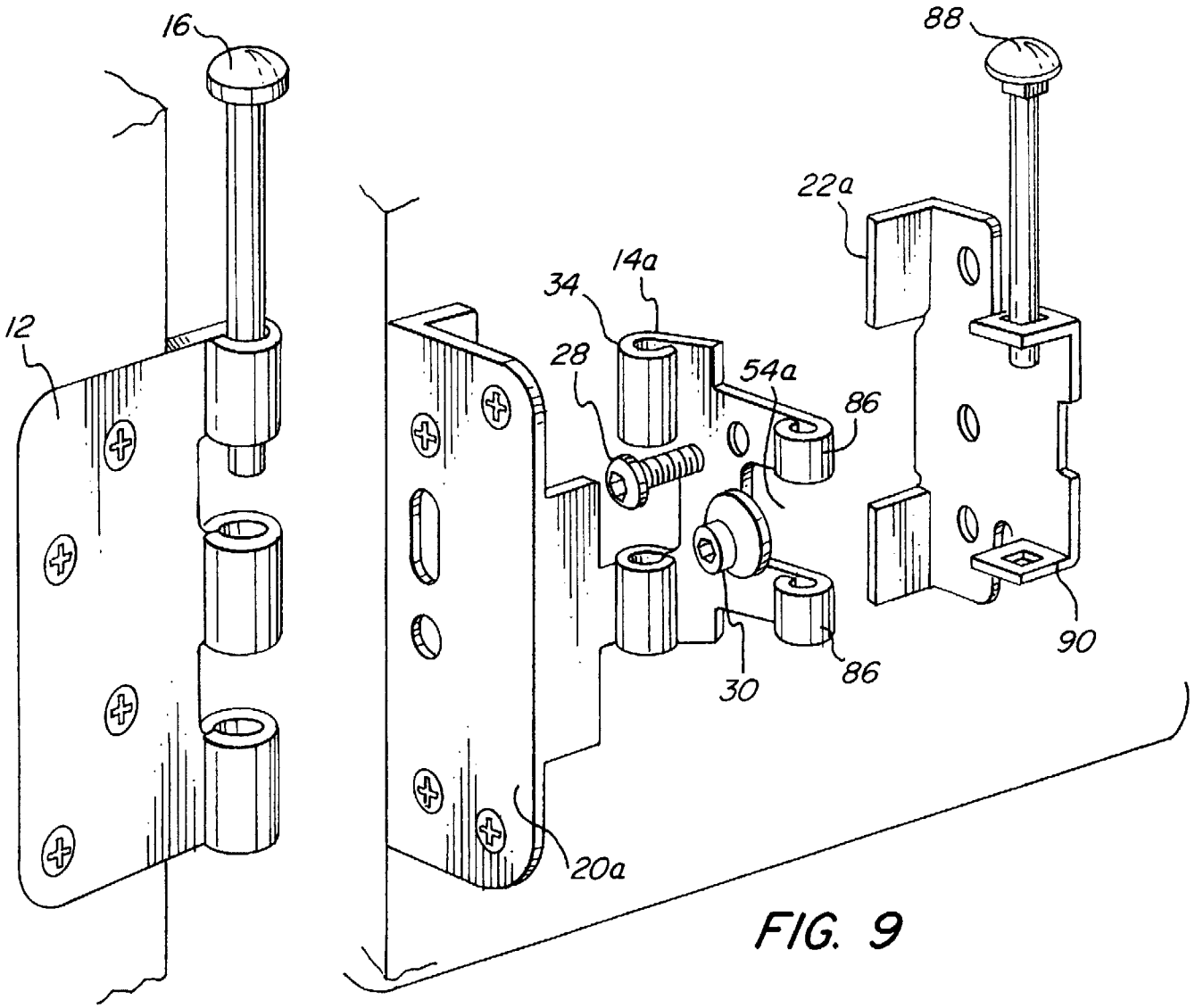
FIG. 9 is an exploded view of another embodiment of an adjustable hinge embodying the present invention having a door leaf with a barrel pivotally mounted on the mounting assembly.

In the embodiment shown in FIG. 9, the tongue 58 on the door leaf 14 may be replaced by a vertically extending barrel with a pair of knuckles 86 to form the pivotal connection with the bracket **22*a*. This barrel is pivotally mounted and axially movable upon the shaft 88, which is in turn, mounted upon tabs 90 formed on the inner end of the bracket 22*a***.

Thus, it can be seen from the foregoing detailed description and the accompanying drawings that the novel adjustable hinge of the present invention is one which allows facile vertical and horizontal adjustment of a door with respect to a frame without requiring loosening or removal of the hinge from the door or the frame.

Having thus described the invention, what is claimed is:

1. An adjustable hinge for pivotally mounting a door to a frame, comprising:

(a) a first leaf adapted to be mounted on one of a frame and a door;

(b) an adjustable leaf mounting assembly adapted to be mounted on the other of the frame and door and including (i) a bracket;

(ii) a second leaf mounted on said bracket and having one end extending beyond said bracket and pivotally engaged with said first leaf;

(iii) a cam rotatably mounted on said bracket and cooperating with a cam follower surface on said second leaf; and (iv) an adjusting screw having a shank threadably engaged in said second leaf intermediate the ends thereof and having its free end abutting said bracket, whereby the rotation of said adjusting screw pivots said one end of said second leaf relative to said bracket and the rotation of said cam moves said second leaf vertically relative to said bracket.

2. The adjustable hinge in accordance with claim 1 wherein said cam includes means for rotating said cam, said cam follower surface is provided by a recess in said second leaf in which said cam is rotatably seated, said cam follower surface bearing upon said cam.

3. The adjustable hinge in accordance with claim 2 wherein said cam is of generally cylindrical configuration mounted for rotation about an eccentric axis.

4. The adjustable hinge in accordance with claim 3 wherein said recess in said second leaf is a horizontally extending slot.

5. The adjustable hinge in accordance with claim 1 wherein said bracket includes a locking portion, said locking portion and said cam having interengaging means for controlling rotation of said cam relative to said bracket.

6. The adjustable hinge in accordance with claim 5 wherein said interengaging means on said locking portion and said cam include tooth surfaces on said cam and cooperating tooth surfaces on said locking portion whereby said teeth abut and prevent inadvertent rotation of said cam relative to said locking portion.

7. The adjustable hinge in accordance with claim 6 wherein said cam has a cylindrical shaft extending eccentrically from said one end thereof and said locking portion has a circular aperture in which said cam shaft is disposed, said teeth of said cam being disposed about said cam shaft and said teeth of said locking portion being disposed concentrically of said circular aperture.

8. The adjustable hinge in accordance with claim 6 wherein the angular spacing of said teeth of said cam and said locking member is unequal whereby only a portion of the number of said teeth abut and control rotation of said cam relative to said locking member.

9. The adjustable hinge in accordance with claim 6 wherein said teeth of said cam and said locking member are cooperatively configured to allow rotation in one direction.

10. The adjustable hinge in accordance with claim 1 wherein said bracket includes means pivotally engaging the other end of said second leaf on said bracket.

11. The adjustable hinge in accordance with claim 10 wherein said means pivotally engaging said second leaf includes a recess in said bracket in which the other end of said second leaf is pivotally seated.

12. The adjustable hinge in accordance with claim 10 wherein said means pivotally engaging said bracket includes a cover portion and a base portion, said second leaf being disposed between said cover portion and said base portion.

13. The adjustable hinge in accordance with claim 1 wherein said means pivotally mounting said second leaf includes a vertically extending shaft fixed on said bracket, the other end of said second leaf having a vertically extending barrel, said barrel being pivotable about and axially movable upon said shaft.

14. The adjustable hinge in accordance with claim 13 wherein said barrel of said second leaf is provided by a pair of knuckles, said cam follower surface is provided by a recess in said second leaf between said knuckles in which said cam is rotatably seated, said cam follower surface bearing upon said cam.

15. An adjustable hinge for pivotally mounting a door to a frame, comprising:

(a) a first leaf adapted to be mounted on one of a frame and a door;

(b) an adjustable leaf mounting assembly adapted to be mounted on the other of the frame and door and including (i) a bracket including a locking portion;

(ii) a second leaf mounted on said bracket and having one end extending beyond said bracket and pivotally engaged with said first leaf, said bracket including means pivotally engaging the other end of said second leaf on said bracket;

(iii) a cam rotatably mounted on said bracket and cooperating with a cam follower surface on said second leaf, said locking portion and said cam having interengaging means for controlling rotation of said cam relative to said bracket, said cam including means for rotating said cam, said cam follower surface provided by a recess in said second leaf in which said cam is rotatably seated, said cam follower surface bearing upon said cam, said cam having interengaging means for controlling rotation of said cam relative to said bracket; and (iv) an adjusting screw having a shank threadably engaged in said second leaf intermediate the ends thereof and having its free end abutting said bracket, whereby the rotation of said adjusting screw pivots said one end of said second leaf relative to said bracket and the rotation of said cam moves said second leaf vertically relative to said bracket.

16. The adjustable hinge in accordance with claim 15 wherein said interengaging means on said locking portion and said cam include tooth surfaces on said cam and cooperating tooth surfaces on said locking portion whereby said teeth abut and prevent inadvertent rotation of said cam relative to said locking portion.

17. The adjustable hinge in accordance with claim 16 wherein said cam has a cylindrical shaft extending eccentrically from said one end thereof and said locking portion has a circular aperture in which said cam shaft is disposed, said teeth of said cam being disposed about said cam shaft and said teeth of said locking portion being disposed concentrically of said circular aperture, the angular spacing of said teeth of said cam and said locking member is unequal whereby only a portion of the number of said teeth abut and control rotation of said cam relative to said locking member, and said teeth of said cam and said locking member are cooperatively configured to allow rotation in one direction.

18. The adjustable hinge in accordance with claim 15 wherein said means pivotally engaging said second leaf includes a recess in said bracket in which the other end of said second leaf is pivotally seated, said means pivotally engaging said bracket includes a cover portion and a base portion, and said second leaf being disposed between said cover portion and said base portion.

19. The adjustable hinge in accordance with claim 15 wherein said means pivotally mounting said second leaf includes a vertically extending shaft fixed on said bracket, the other end of said second leaf having a vertically extending barrel, said barrel being pivotable about and axially movable upon said shaft, said barrel of said second leaf is provided by a pair of knuckles, said cam follower surface is provided by a recess in said second leaf between said knuckles in which said cam is rotatably seated, and said cam follower surface bearing upon said cam.

* * * * *